US005903988A

United States Patent [19]

Tochizawa et al.

[11] Patent Number: 5,903,988

[45] Date of Patent: May 18, 1999

[54] CONTROL DEVICE FOR USE IN A WORKING MACHINE HAVING THREE OR MORE ARMS FOR CONTROLLING PATH OF MOVEMENT OF A TOOL MOUNTED ON ONE OF THE ARMS

[75] Inventors: Mamoru Tochizawa, Takaoka; Atsushi Nagira, Hiratsuka, both of Japan

[73] Assignee: Komatsu Ltd., Tokyo, Japan

[21] Appl. No.: 08/666,413

[22] PCT Filed: Dec. 22, 1994

[86] PCT No.: PCT/JP94/02186

§ 371 Date: Jun. 21, 1996

§ 102(e) Date: Jun. 21, 1996

[87] PCT Pub. No.: WO95/18271

PCT Pub. Date: Jul. 6, 1995

[30] Foreign Application Priority Data

Dec. 24, 1993 [JP] Japan ..... 5-327831

[51] Int. Cl.[6] ..... E02F 5/02

[52] U.S. Cl. ..... 37/348; 414/699; 701/50

[58] Field of Search ..... 37/348, 382, 414; 172/2; 364/424.07; 414/699; 701/50

[56] References Cited

U.S. PATENT DOCUMENTS

| | | | |
|---|---|---|---|
| 4,888,890 | 12/1989 | Studebaker et al. | 37/348 |
| 5,438,771 | 8/1995 | Sahm et al. | 37/348 |
| 5,442,868 | 8/1995 | Ahn | 37/348 |
| 5,446,980 | 9/1995 | Rocke | 37/348 |
| 5,446,981 | 9/1995 | Kamada et al. | 37/348 |
| 5,479,729 | 1/1996 | Eslambolchi | 37/348 |
| 5,535,532 | 7/1996 | Fujii et al. | 37/348 |

FOREIGN PATENT DOCUMENTS 1-278623 9/1988 Japan .

*Primary Examiner*—Victor Batson
*Attorney, Agent, or Firm*—Baker & Daniels

[57] ABSTRACT

A control device for working machines capable of controlling the moving of a tool continuously over a wide range, and capable of moving it accurately along a desired path. Out of not less than three control shafts (3*a*, 4*a*, 5*a*), a first combination of two control shafts (3*a*, 5*a*) is selected, and a bucket (6) is moved in a first section (A–B) out of travelling path thereof with the driving of the two selected shafts (3*a*, 5*a*) controlled. A second combination of two control shafts (3*a*, 4*a*) which is different from the selected first combination of two control shafts (3*a*, 5*a*) is then selected, and the bucket (6) is moved in a second section (B–C), which is continuous from the first section (A–B), with the driving of the two selected shafts (3*a*, 4*a*) controlled.

10 Claims, 7 Drawing Sheets

20
HYDRAULIC CIRCUIT
31
7 8 9 10
CONTROL UNIT
30
NOMAL CONTROL COMPUTATION
28
TRANSITION CONTROL COMPUTATION
29
A/D
32
11
12
13
14
MAIN CONTROL SHAFT SELECTION
26
GROUND ANGLE CONSTANCY CONTROL ON/OFF JUDGEMENT
27
25
M4 M5
M3
M6
M2
M1
24
Vx
V
Vy
21
22
ON
OFF
23
3a,11
4a,12
3
7
4
9
8
6a,14
5a,13
5
10
6
6a

CONTROL DEVICE FOR USE IN A WORKING MACHINE HAVING THREE OR MORE ARMS FOR CONTROLLING PATH OF MOVEMENT OF A TOOL MOUNTED ON ONE OF THE ARMS

TECHNICAL FIELD

The present invention relates to a control device for working machines, and more particularly to a control device which moves the bucket blade tip of a construction machine such as a hydraulic shovel along a predetermined path.

BACKGROUND ART

Hydraulic shovels carry out what may be termed horizontal levelling work and the like using a bucket. When carrying out such horizontal levelling work and the like, it is desirable that the bucket blade tip moves automatically, and that the range of movement of the bucket blade tip is as wide as possible.

Thus, devices which control the path of movement of the blade tips of buckets on hydraulic shovels have already been the subject of various patent applications.

For example, Published Japanese Patent Application Sho. 54-37406 discloses a device which automatically excavates in a straight-line, but even though this device eliminates the tiresomeness of manual operation, it does entail problems in that it is arranged in such a way that the automatic operation is stopped whenever the drive shaft of any of a boom or arm, etc. reaches the end of its stroke, and the range of movement of the bucket blade tip under automatic operation is limited by the stroke of the working machine. For example, if a bucket 6 is moved in a pushing direction as illustrated by the arrow I in FIG. 9, and the blade tip 6*b* of the bucket 6 reaches the position B, then the hydraulic cylinder 8 for the second arm 4 will arrive at the end of its extension stroke, and at this point it automatically stops. In this case, the working area is over a narrow range in the zone C–B.

Further, Laid-open Japanese Patent Application Sho. 63-65507 discloses a technique whereby an operator inputs restricting conditions apply during automatic control of the path of movement of the bucket blade tip and the drive shaft is automatically selected in accordance with the restricting conditions which are input.

However, even assuming that the operator is experienced, he will not always be able to input the right restricting conditions and there are cases where the control will not be accurate. There are also problems in that, similar to the device in the Japanese patent document mentioned above, the working machine will stop when the drive shaft reaches the end of its stroke during its work, other restricting conditions have to be re-input to achieve any further movement and the continuity of the work is interrupted.

The present invention has taken this situation into account, and aims to provide a control device which is able to control the movement of the tools of working machines continuously and over a wide range, and which is able to move the tools of working machines accurately along a desired path.

DISCLOSURE OF THE INVENTION

Thus, a first invention which is a major part of this invention is a control device for working machines having three or more arms connected to each other with freedom of rotation via joints, arranged in such a way as to control the drive of each of the control shafts of the three or more arms such that a tool provided at the front end of the front arm moves along a predetermined path, wherein the tool is moved in a first zone in the path of movement of the tool by selecting a first combination of two control shafts among the three or more control shafts and controlling the drive of the two control shafts which are selected, and the tool is moved in a second zone continuing from the first zone by selecting a second combination of two control shafts different from the first selected combination of two control shafts and controlling the drive of the two control shafts which are selected in the second combination.

Further, a second invention which is a major part of this invention is a control device for working machines having three or more arms connected to each other with freedom of rotation via joints, arranged in such a way as to control the drive of each of the control shafts of the three or more arms in such a way that a tool provided at the front end of the front arm moves along a predetermined path, and a predetermined arm among the three or more arms maintains a constant attitude in a first zone in the path of movement, wherein the tool is moved in the first zone by selecting a first combination of two control shafts among the control shafts with the exception of the control shaft of the predetermined arm, and controlling the drive of the two control shafts which are selected, the attitude of the predetermined arm is kept constant by controlling the drive of the predetermined arm control shaft, and the tool is moved in a second zone continuing from the first zone by selecting a second combination of two control shafts different from the first selected combination of two control shafts and controlling the drive of the two control shafts which are selected in the second combination.

According to the configuration of the first invention, assuming the case in FIG. 6 in which a working machine is moving to a pushing excavation side, the tool 6 is moved in a first zone C–B in the path of movement of the tool 6 by selecting a first combination 3*a* and 4*a* of two control shafts among the three or more control shafts 3*a*, 4*a* and 5*a* and controlling the drive of the two control shafts 3*a* and 4*a* which are selected. Then, the tool 6 is moved in a second zone B–A continuing from the first zone C–B by selecting a second combination 3*a* and 5*a* of two control shafts different to the first selected combination 3*a* and 4*a* of two control shafts and controlling the drive of the selected two control shafts 3*a* and 5*a*.

Further, according to the configuration of the second invention, assuming the case in FIG. 6 in which a working machine is moving to a pushing excavation side, the tool 6 is moved in the first zone C–B by selecting a first combination 3*a* and 4*a* of two control shafts among the various control shafts 3*a* and 4*a*, with the exception of the control shaft 5*a* of a predetermined arm 5, and controlling the drive of the two control shafts 3*a* and 4*a* which are selected. At this time, as shown in FIG. 11(*b*), the control shaft 5*a* of the arm 5 is controlled so as to change from $\theta'$ to $\theta$ and the angle $\delta 3$ of the arm 5 relative to the ground is kept constant.

Further, the tool 6 is moved in a second zone B–A continuing from the first zone C–B by selecting a second combination 3*a* and 5*a* of two control shafts different to the first combination 3*a* and 4*a* and controlling the drive of the selected two control shafts 3*a* and 5*a*.

BEST MODE FOR CARRYING OUT THE INVENTION

An embodiment of the control device for working machinery according to the present invention is described below with reference to the drawings.

Figure 6:
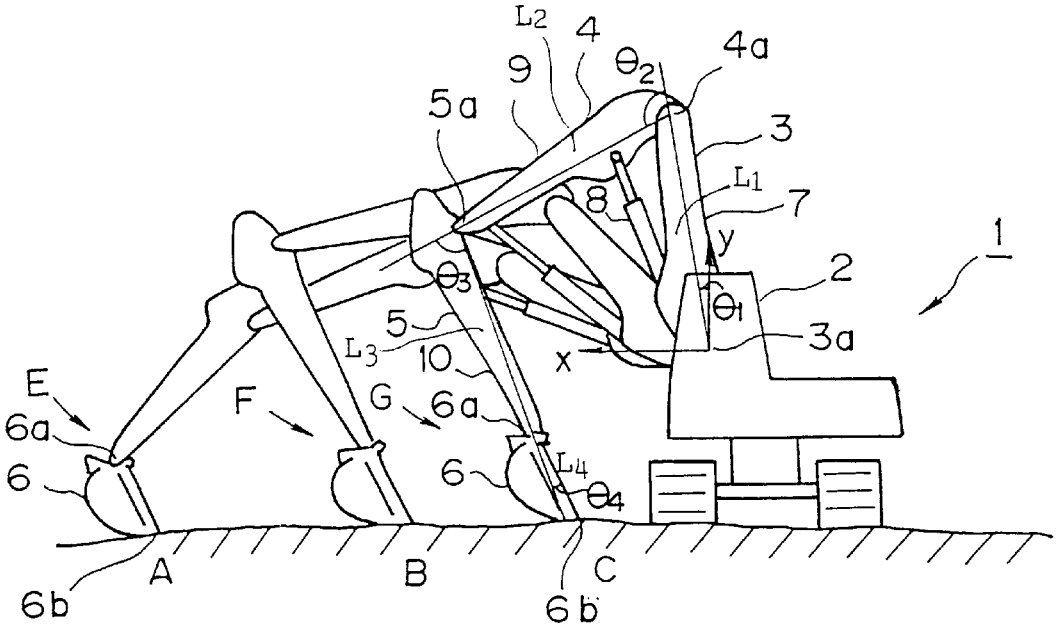
FIG. 6 is a side view illustrating the appearance of the hydraulic shovel used in the embodiment, and illustrating how the attitude of the working machine changes.

FIG. 6 is a view illustrating the appearance of the hydraulic shovel 1 which is the working machine used in the embodiment, and illustrating how the attitude of the working machine changes.

Figure 1:
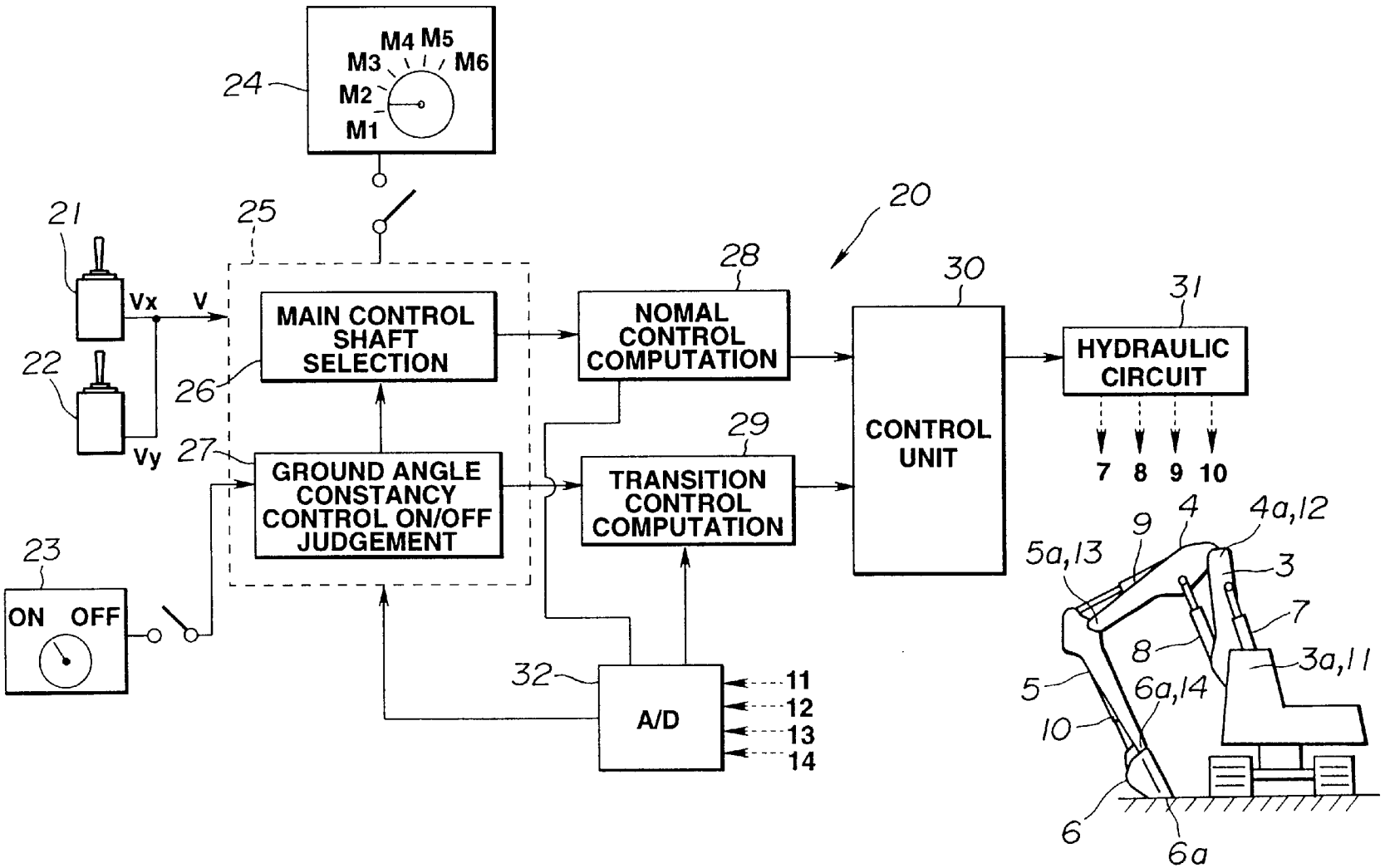
FIG. 1 is a block diagram showing the configuration of an embodiment of the control device for working machines according to the present invention.
Figure 2:
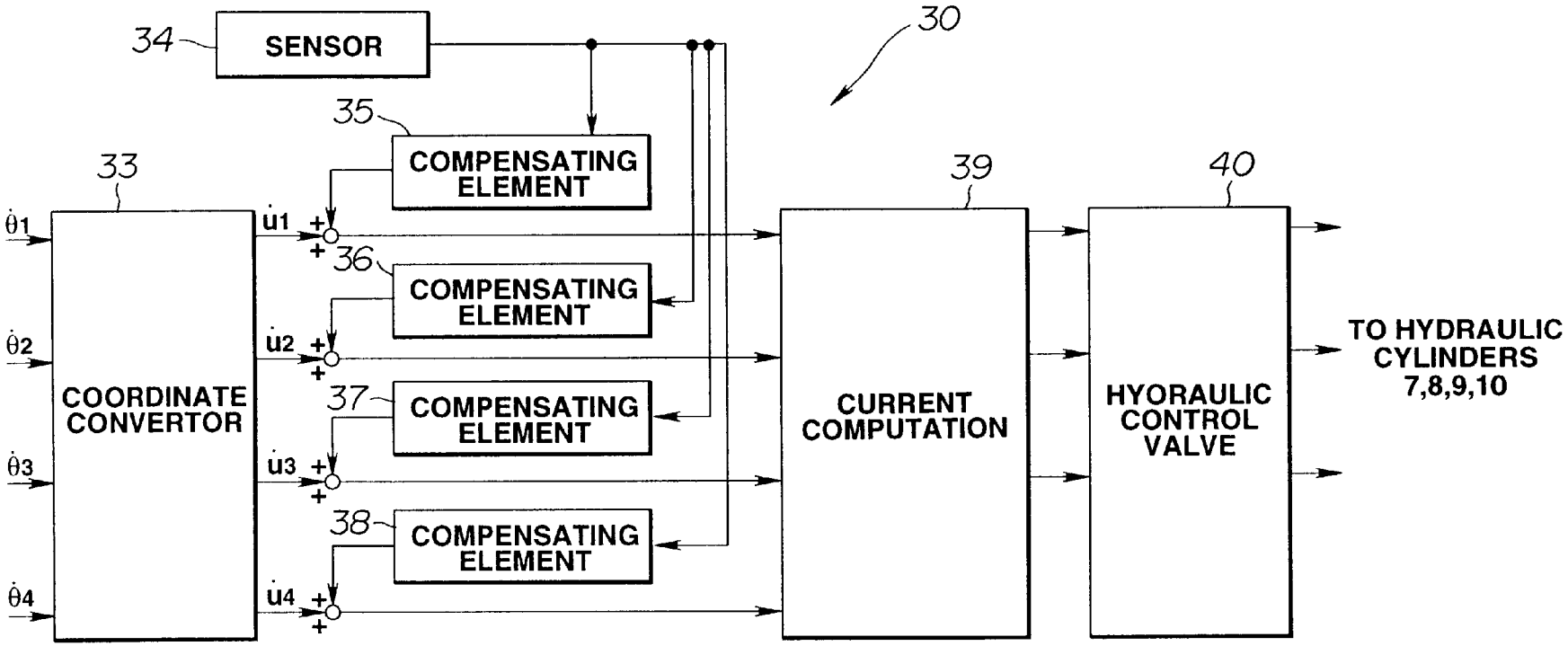
FIG. 2 is a block diagram illustrating the configuration of the control unit shown in FIG. 1.

In addition, FIG. 1 is a block diagram showing the configuration of a control device mounted on the hydraulic shovel 1, and FIG. 2 is a block diagram illustrating the configuration of the control unit 30 in FIG. 1 in greater detail.

As shown in FIG. 6, a first boom 3 is provided, with freedom of rotation via a joint (control shaft) 3*a*, on the revolving frame 2 of the hydraulic shovel 1. On the front end of the first boom 3, a second boom 4 is provided with freedom of rotation via a joint 4*a*, and an arm 5 is similarly provided via a joint 5*a*. A bucket 6 is provided with freedom of rotation, via a joint 6*a*, on the front end of the arm 5. The angles of rotation of the first boom 3 and second boom 4, arm 5 and bucket 6 are respectively represented by θ1, θ2, θ3 and θ4, and L1 is the distance between the rotational support point 3*a* of the first boom 3 and the rotational support point 4*a* of the second boom 4, L2 is the distance between the rotational support point 4*a* of the second boom 4 and the rotational support point 5*a* of the arm 5, L3 is the distance between the rotational support point 5*a* of the arm 5 and the rotational support point 6*a* of the bucket 6, and L4 is the distance between the rotational support point 6*a* of the bucket 6 and the bucket blade tip 6*b*.

The first boom 3 is driven by a hydraulic cylinder 7, the second boom 4 is driven by a hydraulic cylinder 8, the arm 5 is driven by a hydraulic cylinder 9, and the bucket 6 is driven by a hydraulic cylinder 10. By controlling the drive of the various hydraulic cylinders as desired in this way, the bucket blade tip 6*b* is moved to the pushing excavation side as indicated by C→B→A, or is moved to the pulling excavation side as indicated by A→B→C. Further, an x–y coordinate system is defined as in FIG. 6 in order to express the positions where the bucket blade tip 6*b* moves as two dimensional coordinates.

Hydraulic fluid from a hydraulic circuit 31, as shown in FIG. 1, is supplied to the cylinder chambers of the hydraulic cylinders 7, 8, 9 and 10, thereby extending or contracting the rods of the cylinders and changing the attitudes of the corresponding booms, arm and bucket.

The operating lever 21 is a lever indicating the velocity Vx of the movement of the bucket blade tip 6*b* in the direction of the x axis (see FIG. 6), and a signal indicating the velocity Vx is output with a magnitude corresponding to the amount by which it is operated. Similarly, the operating lever 22 is a lever indicating the velocity Vy of the movement of the bucket blade tip 6*b* in the direction of the y axis (see FIG. 6), and a signal indicating the velocity Vy is output with a magnitude corresponding to the amount by which it is operated. The velocity signals Vx and Vy are synthesized into a velocity vector signal V which is applied to a selection/judgement unit 25.

In this embodiment, the velocity of the movement of the bucket blade tip 6*b* along each axis is indicated separately by the two operating levers, but the invention is not limited to this and it may also be indicated by a dial, or the direction and the absolute value of the velocity of the movement may be indicated separately.

Further, the velocity of the movement may be determined in advance in such a way that the movement of the bucket blade tip 6*b* is started by operating a button.

Meanwhile, the bucket-to-ground angle constancy control indication switch 23 is a switch which indicates whether or not the angle of the bucket 6 to the ground is to be kept constant as will be discussed hereinbelow, and, when the switch has been operated to the side where the ground angle constancy control is "on", a signal to this effect is applied to the selection/judgement unit 25, while when the switch has been operated to the side where the ground angle constancy control is "off", a signal to this effect is applied to the selection/judgement unit 25.

As discussed hereinbelow, a work mode selection unit 24 is provided to select and indicate the desired work mode corresponding to the prevailing conditions, from a plurality of work modes which the hydraulic shovel 1 carries out, and a signal indicating a work mode selected from the work modes M1 to M6 is input to the selection/judgement unit 25.

Meanwhile, rotation sensors 11, 12, 13 and 14, which detect the rotational angles of the first boom 3, second boom 4, arm 5 and bucket 6, are provided on the rotational support points 3*a*, 4*a*, 5*a* and 6*a*. Sensors of a rotational type such as potentiometers and encoders for example may be used for these rotation sensors 11, 12, 13 and 14, and the rotational angles may be detected directly from the output of the sensors, or sensors which detect the amounts of the strokes of the cylinders may be used and the rotational angles detected indirectly from the output of these sensors. The output of the rotation sensors 11, 12, 13 and 14 is input via the A/D convertor 32 to the selection/judgement unit 25, and also input to a normal control computation unit 28 and a transition control computation unit 29.

A ground angle constancy control on/off judgement unit 27 in the selection/judgement unit 25 judges whether or not ground angle constancy control as discussed hereinbelow is to be carried out.

A main control shaft selection unit 26 in the selection/judgement unit 25 selects the main control shafts, in other words the control shafts 3*a*, 4*a*, 5*a* and 6*a* used to move the bucket blade tip 6*b*, and selects control shafts which do not participate in the movement as auxiliary shafts. The main control shafts and auxiliary control shafts experience at least one switch in the overall range in which the bucket blade tip 6*b* moves, as discussed hereinbelow.

The results of the selection and judgement by the selection/judgement unit 25 are output to the normal control computation unit 28 and the transition control computation unit 29.

The normal control computation unit 28 computes the angular velocities of the various control shafts before and after the switching of the control shafts, in other words the angular velocities θ1·, θ2·, θ3· and θ4· of the first boom 3 and the like. It will be noted that the mark "·" denotes the first differential of time.

The transition control computation unit 29 computes the angular velocities θ1·, θ2·, θ3· and θ4· of the first boom 3, the boom 4, the arm 5 and the bucket 6, respectively during the control shaft switching transition mode, and the computation results are output to the control unit 30.

The control unit 30 is configured as shown in FIG. 2: the angular velocities θ1·, θ2·, θ3· and θ4· of the first boom 3, the boom 4, the arm 5 and the bucket 6, respectively are input to a coordinate convertor unit 33 and respectively converted to the movement velocities u1·, u2·, u3· and u4· of the rods of the corresponding hydraulic cylinders 7, 8, 9 and 10. Meanwhile, the output of a compensating sensor, such as a pressure sensor 34, is applied to compensating elements 35, 36, 37 and 38, and compensating amounts are respectively output from these compensating elements 35, 36, 37 and 38. The compensating amounts output from the compensating elements 35, 36, 37 and 38 are respectively applied to the movement velocities u1·, u2·, u3· and u4· for control stability, and a signal giving the sum of these movement velocities and compensating amounts is applied to an electrical current computation unit 39.

Based on the input addition signal corresponding to the various hydraulic cylinders, the current computation unit 39 outputs a control signal to a hydraulic control valve 40 corresponding to the various hydraulic cylinders. As a result, the hydraulic control valve 40 is driven to a valve position corresponding to the applied control signal, and the hydraulic oil corresponding to the valve position is supplied to the cylinder chambers of the various hydraulic cylinders 7, 8, 9 and 10.

As a result, the rods of the various hydraulic cylinders 7, 8, 9 and 10 extend or contract in such a way that the first boom 3, second boom 4, arm 5 and bucket 6 respectively rotate with the angular velocities θ1·, θ2·, θ3· and θ4· input to the control unit 30.

Figure 3:
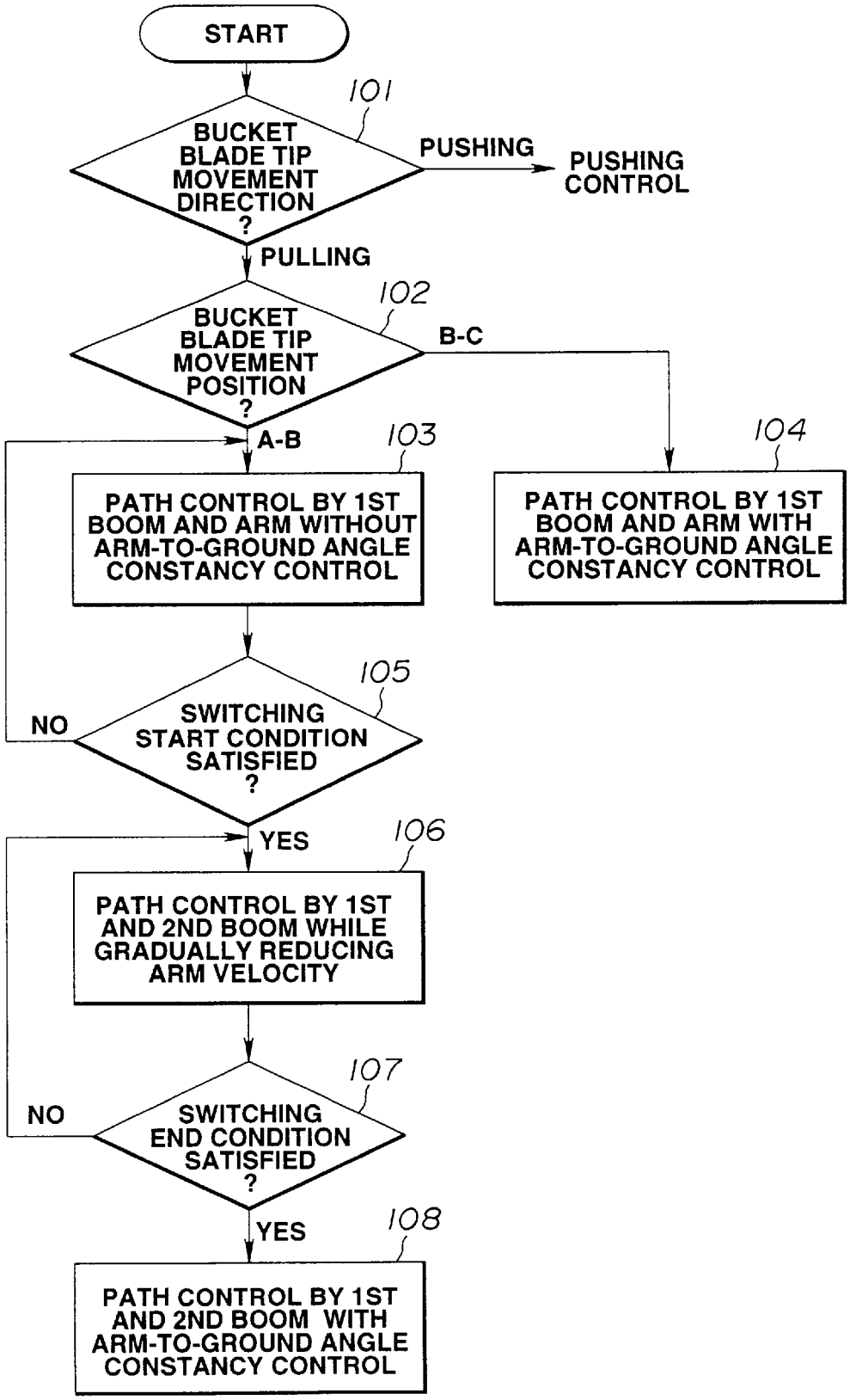
FIG. 3 is a flow chart showing the processing sequence run in the control device shown in FIG. 1.
Figure 7:
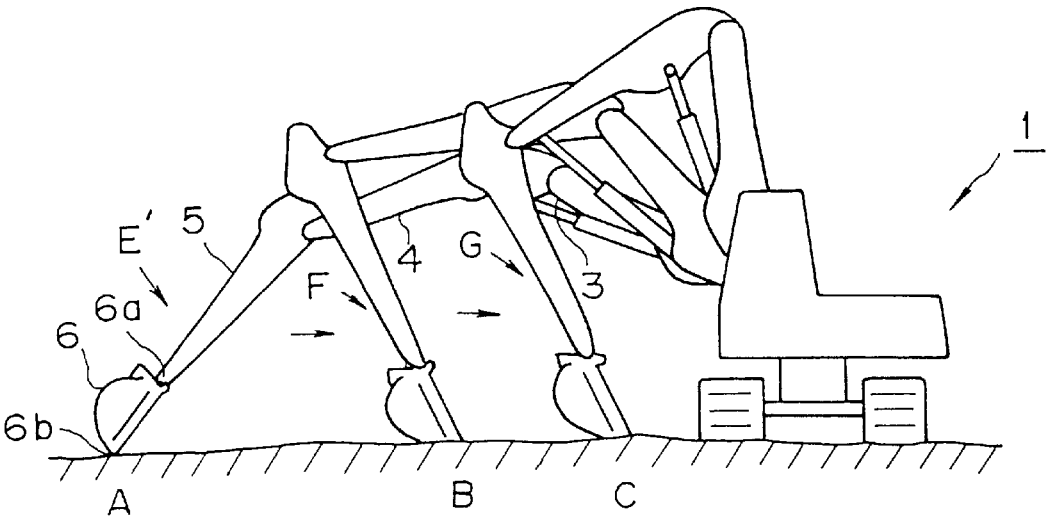
FIG. 7 is a side view illustrating the appearance of the hydraulic shovel used in the embodiment, and illustrating how the attitude of the working machine changes.

FIG. 3 is a flow chart showing the processing procedure for the control of the path of movement of the bucket blade tip 6*b* of the hydraulic shovel 1 when the bucket blade tip 6*b* moves in the pulling excavation side A→B→C as shown by the arrow in FIG. 7.

The invention is described hereinbelow referring also to this flow chart. It will be noted that a situation in which the bucket 6 does not move is described for simplicity.

To elaborate, firstly a judgement is made (Step 101) in the main control shaft selection unit 26 as to whether the current movement direction of the bucket blade tip 6*b* is the pushing side or the pulling side, based on the input velocity vector V. Then, if it is Judged that the bucket 6 is moving in the pushing direction, pushing control corresponding to the pushing side discussed hereinbelow is carried out.

Here, if it is decided that the bucket 6 is currently moving in the pulling direction, the main control shaft selection unit 26 computes the current position (x, y) which is the excavation starting position for the bucket blade tip 6*b* based on the various input rotational angles θ1, θ2, θ3 and θ4, and judges whether or not the current position belongs to either of the zones A–B or B–C, in the path of movement A–C of the bucket blade tip 6*b*, which are zones around the switching of the main control shaft and auxiliary control shaft. It should be noted that A–B and B–C, which are zones around the switching of the main control shaft and auxiliary control shaft mentioned above, are set in advance.

Further, the current position (x, y) of the bucket blade tip 6*b* can be determined by the following computational formula as will be clear from FIG. 6.

$$x=L1\sin\theta1+L2\sin(\theta1+\theta2)+L3\sin(\theta1+\theta2+\theta3)+L4\sin(\theta1+\theta2+\theta3+\theta4) \quad (1)$$

$$y=L1\cos\theta1+L2\cos(\theta1+\theta2)+L3\cos(\theta1+\theta2+\theta3)+L4\cos(\theta1+\theta2+\theta3+\theta4) \quad (2)$$

(Step 102)

Because this involves a case in which the operator maneuvers the bucket blade tip 6*b* to the pulling side with position A as the starting point, it is judged that the bucket 6 belongs to the one A–B, and as a result the main control shaft selection unit 26 makes a selection and judgement that the first boom 3 (3*a*) and arm 5 (5*a*) should be main control shafts and that the second boom 4 (4*a*) should be an auxiliary control shaft (fixed angle). It will be noted that this combination of main control shaft and auxiliary control shaft is set in advance depending on the zone. Thus, the zone B–C is set to a different combination to the combination of control shafts in zone A–B, namely the main control shafts are the first boom 3 (3*a*) and second boom 4 (4*a*), and the auxiliary control shaft is the arm 5 (5*a*). Further, this combination can be set to a different combination depending on the work mode. The combination described above in which the first boom 3 (3*a*) and arm 5 (5*a*) are the main control shafts and the second boom 4 (4*a*) is the auxiliary control shaft in the region A–B can be set as the combination for when the "normal mode" M1 has been selected.

Further, the ground angle constancy control on/off judgement unit 27 judges that "arm-to-ground angle constancy control" is not carried out in the zone A–B. It will be noted that whether ground angle constancy control is to be carried out or not is set in advance depending on the zone. Thus, the fact that "arm-to-ground angle constancy control" is carried out in zone B–C is set in advance. Further, whether ground angle constancy control is to be carried out or not can also be set according to the work mode. The judgement not to carry out ground angle constancy control in the zone A–B can be set as a judgment for when the "normal mode" M1 has been selected. However, when the bucket-to-ground angle constancy control has been indicated by the bucket-to-ground angle constancy control indication switch 23, the control shaft 10 for the bucket 6 is driven even in the zone A–B, the control being such that the angle of the bucket 6 to the ground is constant in the zone A–B as shown in FIG. 6 (see states E and F in FIG. 6).

When selecting the main control shaft or auxiliary control shaft and making a judgment about ground angle constancy control in this way, the angular velocities θ1· and θ3· of the various control shafts 3*a* and 5*a* for moving the bucket 6 in the zone A–B are computed by the normal control computation unit 28 in the following way:

the angle δ3 of the arm 5 to the ground is expressed by $$\delta 3=\theta 1+\theta 2+\theta 3 \tag{3}$$

and the angle δ4 of the bucket 6 relative to the ground is expressed by $$\delta 4=\theta 1+\theta 2+\theta 3+\theta 4 \tag{4}$$

Now, when the bucket θ4 is not moving, the angle δ4 of the bucket to the ground will be constant if the angle δ3 of the arm to the ground is constant as will be clear from the formulae (3) and (4).

Here, because θ4·=0, the following result is obtained when the above formulae (1) to (3) are differentiated:

$$\begin{pmatrix} \dot{x} \\ \dot{y} \\ \dot{\delta}_3 \end{pmatrix} = \begin{pmatrix} a_{11} & a_{12} & a_{13} \\ a_{21} & a_{22} & a_{23} \\ a_{31} & a_{32} & a_{33} \end{pmatrix} \begin{pmatrix} \dot{\theta}_1 \\ \dot{\theta}_2 \\ \dot{\theta}_3 \end{pmatrix} = A \begin{pmatrix} \dot{\theta}_1 \\ \dot{\theta}_2 \\ \dot{\theta}_3 \end{pmatrix} \tag{5}$$

$$\therefore \begin{pmatrix} \dot{\theta}_1 \\ \dot{\theta}_2 \\ \dot{\theta}_3 \end{pmatrix} = \begin{pmatrix} b_{11} & b_{12} & b_{13} \\ b_{21} & b_{22} & b_{23} \\ b_{31} & b_{32} & b_{33} \end{pmatrix} \begin{pmatrix} \dot{x} \\ \dot{y} \\ \dot{\delta}_3 \end{pmatrix} = A^{-1} \begin{pmatrix} \dot{x} \\ \dot{y} \\ \dot{\delta}_3 \end{pmatrix} \tag{6}$$

Here, because the auxiliary control shaft second boom control shaft 4*a* is at a fixed angle, in other words θ2·=0, we can use the formula (6) to establish the relationship:

$$b21x\cdot+b22y\cdot+b23\delta 3\cdot=0 \quad \delta 3\cdot=-(1/b23)\ (b21x\cdot+b22y\cdot) \tag{7}$$

Here, the velocities x·, y· of the movement of the bucket blade tip 6*b* may be set as velocity vectors Vx and Vy, but if control of the path is to be improved, it is more effective to input the difference between the current value and the target value which produces the velocity vector V. In all events, if the velocities x·, y· of the movement of the bucket blade tip 6*b* are applied, the angular velocities θ1·, θ2· (=0) and θ3· of the control shafts 3*a*, 4*a* and 5*a* are computed from the formulae (6) and (7). The angular velocities θ1·, θ2· (=0) and θ3· which are computed in this way are output to the control unit 30, and the various hydraulic cylinders 7 and 9 are driven. As a result, the attitude of the working machine changes from attitude E' to attitude F, and the bucket blade tip 6*b* moves from position A to position B (Step 103).

Next, the main control shaft selection unit 26 and the ground angle constancy control on/off judgement unit 27 judge whether the main control shaft (or auxiliary control shaft) switching starting conditions apply.

Figure 10:
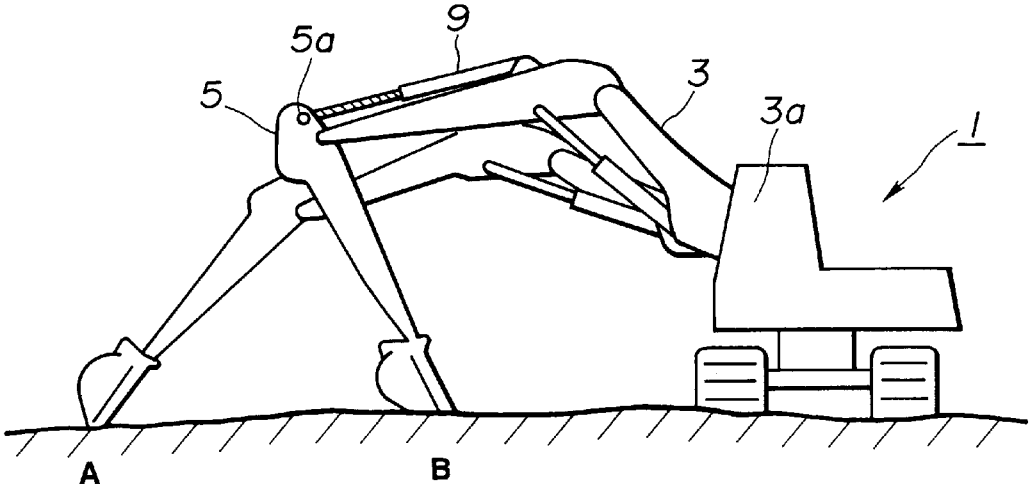
FIG. 10 is a side view illustrating the appearance of the hydraulic shovel used in the embodiment, and illustrating how the attitude of the working machine changes.

To elaborate, assuming that the first boom control shaft 3*a* and arm control shaft 5*a* are taken to be the main control shafts in the control which is carried out without further ado as shown in FIG. 10, and the bucket blade tip 6*b* reaches the position B, then the amount by which the hydraulic cylinder 9 for the arm 5 extends in the position B is at a maximum, in other words it reaches the end of its stroke, and it becomes impossible to continue the control in this mode. Consequently, main control shaft switching is necessary to move the bucket blade tip 6*b* over a wide working range. In this embodiment, control shaft switching control (transition control) is arranged in such a way that it starts before the bucket blade tip 6*b* reaches position B, which is to say before the hydraulic cylinder reaches the end of its stroke, and ends at (immediately before) the time the end of the stroke is reached. Completing the control shaft switching in this way immediately before the hydraulic cylinder reaches the end of its stroke has the advantage that the shock occurring during switching can be cushioned.

Supposing that the main control shaft should switch in an instant at the time that the hydraulic cylinder 9 for the arm 5 reaches the end of its stroke, the angular velocity of the arm 5 would rapidly become zero, there would be a sudden change in velocity in that the arm 5 which had been moving in the pulling direction would have a velocity moving in the pushing direction and shocks would occur, and the path accuracy would also deteriorate.

Thus, in this embodiment the angular velocity is continuously controlled in such a way that the control shaft is not switched abruptly, switching is begun at a predetermined time when there is a little cylinder stroke remaining, and the angular velocity of the various control shafts is continuously changed from the angular velocity before switching to the angular velocity after switching gradually. The path of movement of the bucket blade tip 6*b* is controlled even when this continual control is being carried out, and if a difference should arise between the target angular velocity and the current angular velocity, the first boom 3 and arm 5 are moved in the direction which will eliminate the difference, and the switching proceeds smoothly while the path accuracy is maintained. In this way the switching is ended when the hydraulic cylinder 9 for the arm has more or less reached the end of its stroke, and then control of the movement of the bucket blade tip 6*b* is taken over by a newly selected main control shaft.

Figure 4:
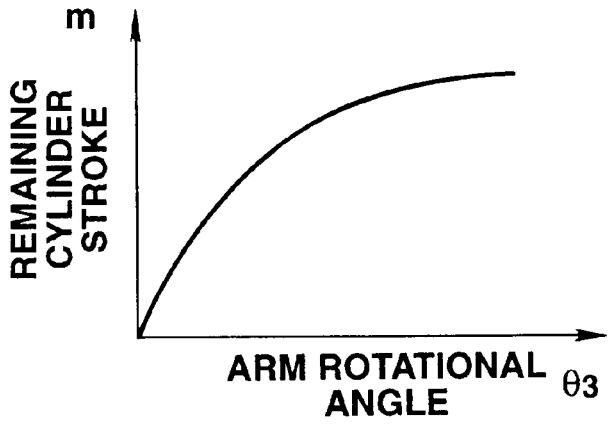
FIG. 4 is a graph used to explain the judgements made by the control device shown in FIG. 1.

FIG. 4 shows the relationship between the rotational angle θ3 of the arm 5 and the remaining amount of stroke m of the hydraulic cylinder 9 for this arm 5.

Using this relationship, the rotational angle θ3 (start) starting the transitional control and the rotational angle θ3 (end) ending the control can be set in advance as outlined below for example.

θ3 (end)=100° when the amount of stroke remaining m is 5 (cm)

θ3 (start)=80° when the amount of stroke remaining m is 15 (cm)

Here, transition control is started when θ3=θ3 (start), and eventually switching ends when θ3 increases and θ3=θ3 (end), so that the system returns from the transition control mode to the normal control mode. The above θ3 (start) and θ3 (end) may be set in advance, but θ3 (start) may be changed depending on the size of the velocity vector V so that the angular velocity does not change rapidly during switching. For example, θ3 (start) can be changed as follows:

when vx>0.5 (m/s), θ3 (start)=70° when 0.5≧vx>0.3, θ3 (start)=80° when 0.1≧vx>0, θ3 (start)=95°

As outlined above, a judgment is made that the switching start conditions have been met when the angular velocity θ3 reaches θ3 (start), and the ground angle constancy control on/off judgement unit 27 outputs a "ground angle constancy control on" condition set for the zone B–C to the transition control computation unit 29, while the main control shaft selection unit 26 outputs the main control shaft and auxiliary control shaft set for the zone B–C to the transition control computation unit 29 (the judgment YES in Step 105), and the procedure proceeds to Step 106.

Figure 5:
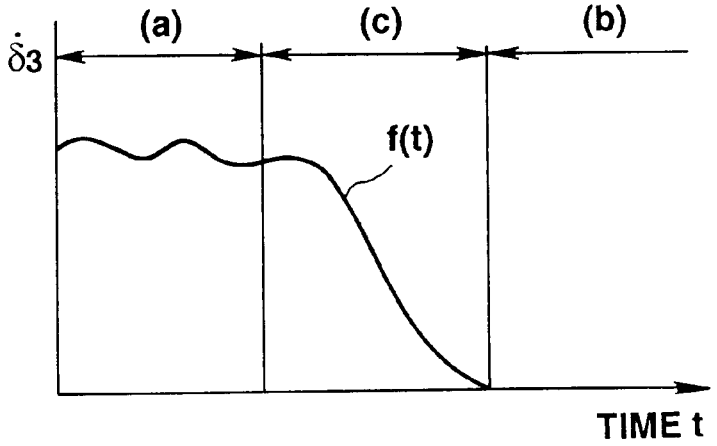
FIG. 5 is a graph used to explain the computations carried out by the control device shown in FIG. 1.

Thereupon, the transition control computation unit 29 judges that the angular velocity δ3· of the arm relative to the ground after control shaft switching is zero based on the condition that "ground angle constancy control is on" which has been input, and judges that the second arm control shaft 4*a* ought to be driven after switching. Here, as shown in FIG. 5, a function δ3=f(t) is produced to continuously vary the angular velocity, from the angular velocity δ3· of the angle of the arm to the ground before control shaft switching (see zone (a)) to the angular velocity δ3· (=0) after switching (zone (b)). This function f(t) may simply be made to converge with the angular velocity (=0) after switching using a primary function, but it is preferable to use a higher order function which takes continuity of acceleration into account.

The function f(t) is determined in this way, and the bucket blade tip velocities x·, y· and the angular velocity δ3· of the arm relative to the ground in the transition control zone (c) (see FIG. 5) set thereby are substituted into the formula (6), thereby computing the angular velocities θ1·, θ2· and θ3· of the control shafts 3*a*, 4*a* and 5*a*.

The angular velocities θ1·, θ2· and θ3· which are computed in this way are output to the control unit 30, and the various hydraulic cylinders 7, 8 and 9 are driven. As a result, the angular velocity of the control shaft 5*a* of the arm 5 is gradually reduced, and the control shafts 3*a* and 4*a* of the first boom 3 and second boom 4 which are the main control shafts in the zone B–C are driven, thereby moving the bucket blade tip 6*b* up to position B (Step 106).

Next, the main control shaft selection unit 26 and the ground angle constancy control on/off judgement unit 27 make a judgement as to whether the main control shaft (or auxiliary control shaft) switching end condition, which is to say θ3=θ3 (end), is satisfied.

When the switching end condition is satisfied, the main control shaft selection unit 26 makes a selection and judgement for the first boom 3 (3*a*) and the second boom 4 (4*a*) to be the main control shafts, and the arm 5 (5*a*) to be the auxiliary control shaft (constant ground angle), the combination of the main control shafts and auxiliary control shaft is output to the normal control computation unit 28 and the ground angle constancy control on/off judgement unit 27 outputs the condition that "ground angle constancy control is on" to the normal control computation unit 28 (the judgement YES in Step 107).

Figure 11A:
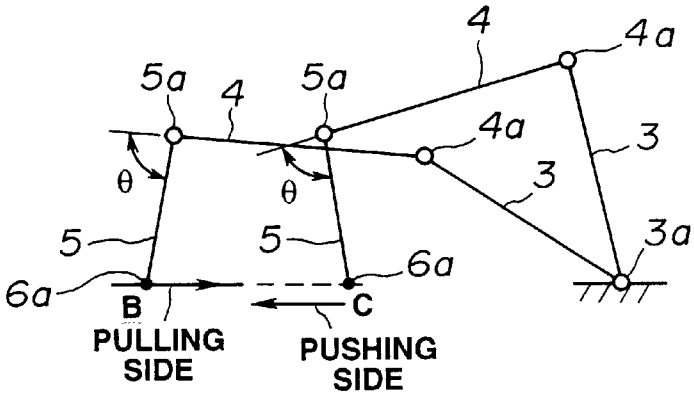
FIGS. 11(*a*) and 11(*b*) compare the difference between the situation when the angle of the arm relative to the ground is not fixed, and the situation when the angle relative to the ground is fixed.
Figure 11B:
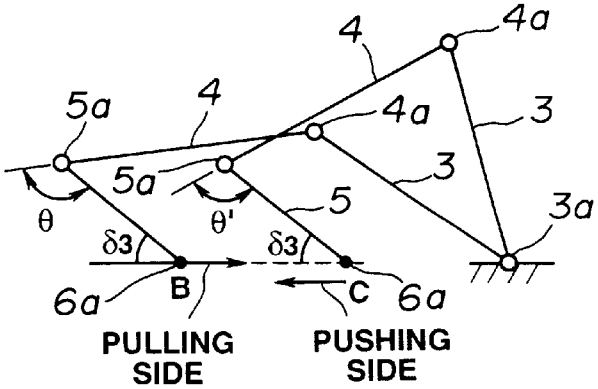

Now, in the zone A–B there is no need for any of the shafts to have a constant ground angle in order to keep the path of the bucket blade tip 6*b* accurate, but in the zone B–C it is desirable for the arm 5 to have a constant ground angle in order to keep the path of the bucket blade tip 6*b* accurate and to expand the working area. The reason being that if, as shown in FIG. 11 (*a*), the control shaft 5*a* of the arm 5 which is the auxiliary control shaft is at a fixed angle θ, there is a risk that the path of the blade tip 6*b* will be broken by the back of the bucket 6.

Moreover, in some instances it will even be possible to have a fixed arrangement in which there is no ground angle constancy control in the zone B–C either, in other words without using the arm control shaft 5*a* constituting the auxiliary control shaft for ground angle constancy control.

Conversely, when it is desired to perform "rolling pressure" work using the bucket 6, it is desirable for the bucket-to-ground angle to be constant over the zone A–B as well, as shown in FIG. 6. In this case, the bucket-to-ground angle constancy control indication switch 23 is manoeuvred to "ground angle constancy control on" as discussed previously so that the bucket 6 is driven and the bucket-to-ground angle is constant in the zone A–B as well, and bucket-to-ground angle constancy control is carried out in the entire working range A–C.

The normal control computation unit 28 judges that the angular velocity δ3· of the arm-to-ground angle is zero based on the input condition that "ground angle constancy control is on", and judges that the second boom control shaft 4*a* which was not being driven should be driven as the main control shaft in the zone A–B. Thus, the angular velocities θ1·, θ2· and θ3· of the various control shafts 3*a*, 4*a* and 5*a* are computed by substituting the condition δ3·=0 and the current bucket blade tip velocities x· and y· into the formula (6).

The angular velocities θ1·, θ2· and θ3· which are computed in this way are output to the control unit 30, and the various hydraulic cylinders 7, 8 and 9 are driven. As a result, the arm-to-ground angle δ3 is kept constant by the driving of the control shaft 5*a* of the arm 5 which is the auxiliary control shaft, the bucket blade tip 6*b* is moved from position B to position C by the driving of the control shafts 3*a* and 4*a* of the first boom 3 and second boom 4 which are the main control shafts in the zone B–C, and the attitude of the working machine is changed from F to G (Step 108). It will be noted that when the bucket blade tip 6*b* begins to move from a position belonging to the zone B–C (the judgment "B–C" in Step 102), processing similar to that in the Step 108 is performed (Step 104).

Moreover, in this embodiment the control shaft switching is carried out near the end of the stroke of the hydraulic cylinder, but there is no need for it to be limited to near the end of the stroke and the switching may be carried out other than near the end of the stroke depending on the work involved. In this case, the switching time can be made to correspond with each work mode selected by the work mode selection unit 24. Further, in this embodiment there was a single switching of control shafts, but two or more switching operations may also be carried out. In this case too, the number of times switching is performed can be made to correspond with each work mode selected by the work mode selection unit 24.

Further, the combinations of main control shafts and auxiliary control shafts are not limited to those discussed above, and different combinations can also be adopted. For example, the second boom 4 and arm 5 may be used as main control shafts. In this case too, the combination can be made to correspond with each work mode selected by the work mode selection unit 24.

Also, shafts which are to have a constant ground angle are not limited to those discussed above, and different shafts can also be adopted. For example, the ground angle of the second boom 4 may be kept constant. In this case too, the shaft which is to have a constant ground angle can be made to correspond with each work mode selected by the work mode selection unit 24.

Further, this embodiment has been described with reference to control on the pulling excavation side, but it can also be put into effect in a similar way in controlling the movement of the bucket blade tip 6*b* in FIG. 7 to the pushing excavation side from positions C→B→A.

Figure 8:
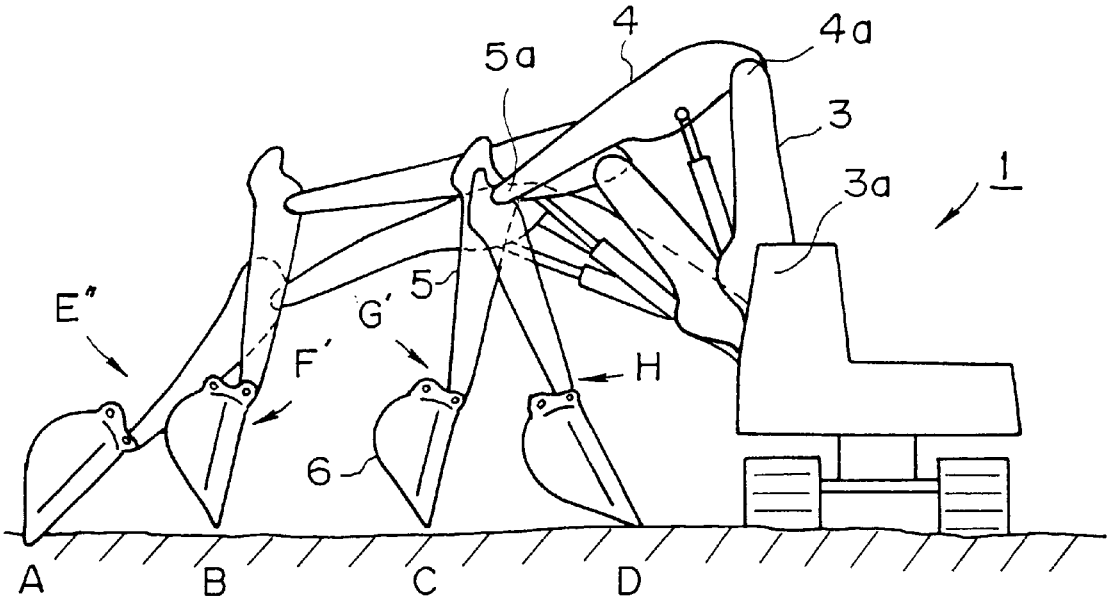
FIG. 8 is a side view illustrating the appearance of the hydraulic shovel used in the embodiment, and illustrating how the attitude of the working machine changes.
Figure 9:
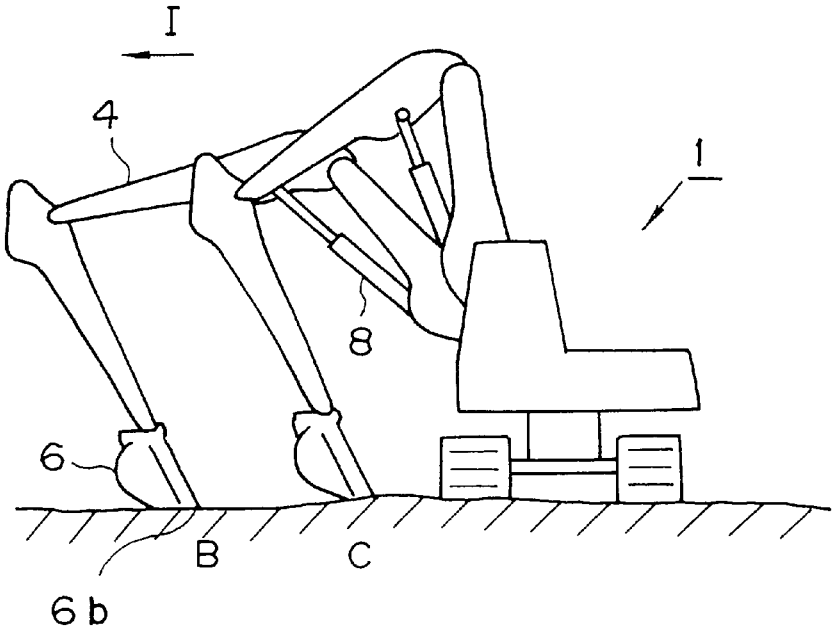
FIG. 9 is a side view illustrating the appearance of the hydraulic shovel used in the embodiment, and illustrating how the attitude of the working machine changes.

FIG. 8 shows, by way of example, how the attitude of the working machine changes when the control shafts are switched twice: switching is carried out with the first boom 3 and arm 5 as the main control shafts and the second boom 4 as the auxiliary control shaft when moving from zone B–C to zone C–D as shown in FIG. 8.

Further, the embodiment assumes a hydraulic shovel as the working machine and assumes that it is equipped with a first boom control shaft 3*a*, a second boom control shaft 4*a* and arm control shaft 5, making a total of three shafts, as the control shafts for moving the bucket, but the invention is not limited to this and any desired configuration can be adopted provided it involves a working machine which moves a tool along a predetermined path, and it may be provided with four or more shafts.

For example, the present invention may similarly be applied to multi-jointed robots for welding work which move a welding torch along a predetermined path using multiple joints.

Industrial Applicability

As described above, using the present invention it is possible to control the movement of a tool continuously over a wide area, and to move it accurately along a desired path. As a result, the working efficiency and accuracy of work are dramatically improved.

I claim:

1. A control device for working machines having three or more arms connected via three or more control shafts for movement relative to each other, comprising control means for controlling a drive of each of the control shafts of the three or more arms such that a tool mounted on one of said arms moves along a predetermined path, wherein said control means includes selecting means for selecting a first combination of two control shafts from among the three or more control shafts and for controlling the drive of the two control shafts which are selected when the tool is moved in a first zone of said predetermined path, said selecting means including means responsive to movement of said tool into a second zone of said predetermined path continuing from the first zone for selecting a second combination of two control shafts different from the first selected combination of two control shafts and controlling the drive of the two control shafts which are selected in the second combination.

2. A control device for working machines as claimed in claim 1, wherein the control means switches from controlling the two control shafts of the first combination to controlling the two control shafts of the second combination when a rotational angle of an arm corresponding to either of the control shafts in the first combination reaches a terminal angle.

3. A control device for working machines as claimed in claim 1, wherein said control means includes means for computing first rotational velocities of the three or more arms when the tool is in the first zone and for computing second rotational velocities of the three or more arms in the second zone, and means for switching the rotational velocities of the three or more arms from the first rotational velocities to the second rotational velocities when said control means switches from controlling the control shafts of the first combination to controlling the control shafts of the second combination.

4. A control device for working machines as claimed in claim 3, wherein said control means includes means initiating control of said arms when a first arm corresponding to one of the control shafts in the first combination reaches a predetermined starting angle, and ending control of the three or more arms when the first arm reaches a predetermined end angle, whereupon said control means switches from controlling the two control shafts in the first combination to controlling the two control shafts in the second combination.

5. A control device for working machines as claimed in claim 4, further comprising tool velocity detection means for detecting a velocity of the movement of the tool, said control means being responsive to said velocity detection means as a function of the velocity detected by the tool velocity detection means.

6. A control device for working machines as claimed in claim 1, wherein said control means includes work mode selection means for selecting a work mode from a plurality of work modes, said control means selecting the first combination or the second combination as a function of the work mode selected by the work mode selection means.

7. A control device for working machines having three or more arms connected via control shafts for movement relative to each other, comprising control means for controlling each of the control shafts of the three or more arms in such a way that a tool, moves along a predetermined path, said three or more arms including a predetermined arm maintaining a constant attitude in a first zone in the path of movement, wherein said control means includes selecting means for selecting a first combination of two control shafts from among the control shafts not including the control shaft of the predetermined arm, and for controlling the drive of the two control shafts which are selected, said control means including means for maintaining an attitude of the predetermined arm constant by controlling the control shaft of the predetermined arm, said selecting means including means responsive to movement of said tool into a second zone of said predetermined path continuing from the first zone for selecting a second combination of two control shafts different from the first selected combination of two control shafts and controlling the two control shafts which are selected in the second combination.

8. A control device for working machines as claimed in claim 7, comprising indication means for initiating a constant attitude control means for keeping an attitude of the tool constant, the constant attitude control means being responsive to the indication means to maintain the attitude of the tool constant.

9. A control device for working machines as claimed in claim 7, wherein said control means includes work mode selection means for selecting a work mode from a plurality of work modes, said control means selecting the predetermined arm which is to be kept at a constant attitude as a function of the work mode selected by the work mode selection means.

10. A control device for working machines having a first boom, a second boom and an arm connected for relative movement with respect to one another and comprising three control shafts for controlling the first boom, second boom and arm respectively such that a blade tip of a bucket provided at a front end of the arm moves along a predetermined path, and control means for controlling said shafts, wherein said control means includes selecting means for selecting a first combination of two controls shafts among the three control shafts and controlling the two control shafts of the first combination to move the blade tip in a first zone of the predetermined path, said selecting means selecting a second combination of two control shafts different from the first combination of two control shafts and controlling the two control shafts which are selected in the second combination to move the blade tip in a second zone of said predetermined path that continues from the said first zone.

* * * * *